United States Patent [19]

Katoh

[11] Patent Number: 4,785,702

[45] Date of Patent: Nov. 22, 1988

[54] TONE SIGNAL GENERATION DEVICE

[75] Inventor: Mitsumi Katoh, Hamamatsu, Japan

[73] Assignee: Nippon Gakki Seizo Kabushiki Kaisha, Hamamatsu, Japan

[21] Appl. No.: 789,471

[22] Filed: Oct. 21, 1985

[30] Foreign Application Priority Data

Oct. 22, 1984 [JP] Japan ..... 59-220465

[51] Int. Cl.[4] ..... G10H 7/00

[52] U.S. Cl. ..... 84/1.01; 84/1.26; 84/1.28

[58] Field of Search ..... 84/1.03, 1.01, 1.19, 84/1.28, 1.23, 1.22, 1.2, 1.26; 331/78

[56] References Cited

U.S. PATENT DOCUMENTS

| | | | |
|---|---|---|---|
| 4,194,427 | 3/1980 | Deutsch | 84/1.03 |
| 4,345,501 | 8/1982 | Nakada et al. | 84/1.03 |
| 4,379,420 | 4/1983 | Deutsch | 84/1.03 |
| 4,383,462 | 5/1983 | Nagai | 84/1.26 |
| 4,502,361 | 3/1985 | Viitanen et al. | 84/1.26 |
| 4,520,708 | 6/1985 | Wachi | 84/1.26 |
| 4,573,389 | 3/1986 | Suzuki | 84/1.26 |
| 4,584,921 | 4/1986 | Wachi | 84/1.01 |
| 4,635,520 | 1/1987 | Mitsumi | 84/1.26 |

*Primary Examiner*—Stanley J. Witkowski

*Attorney, Agent, or Firm*—Spensley Horn Jubas & Lubitz

[57] ABSTRACT

A waveshape memory stores waveshape data representing plural waveshapes each having plural periods. A reading sequence controller designates ones to be read out among said waveshape data from the waveshape memory and the readout order thereof. This order may either be a random order or a predetermined one. By performing the readout of the waveshape data, repetitive reading of the same waveshape data is basically avoided, and a periodical noise and monotonousness in the tone color which tend to arise from such repetitive reading are eliminated.

12 Claims, 5 Drawing Sheets

TONE SIGNAL GENERATION DEVICE

BACKGROUND OF THE INVENTION

This invention relates to a tone signal generation device prestoring sets of waveshapes of plural periods and generating a tone signal by reading them out in a suitable sequential order.

U.S. Pat. No. 4,383,462 discloses a tone signal generation device capable of producing a tone of high quality closely resembling a natural musical instrument by storing a full waveshape from the start of sounding of the tone to the end thereof in a waveshape memory and accessing this waveshape memory. For reducing the memory capacity which tends to become large in this type of device in which a full waveshape is stored in the waveshape memory, this U.S. Patent has adopted a technique according to which a waveshape of an attack portion is stored completely but as to a waveshape of subsequent sustain portion, a representative waveshape of one period or plural periods only is stored and this representative waveshape is read out repeatedly.

This system of repeatedly reading out a waveshape of one period has a problem that the tone color does not change timewise thereby giving a monotonous impression. The system of repeatedly reading out a waveshape of plural periods can more or less avoid such monotonousness but still cannot avoid monotonousness caused by repetition of the tone color change of the same pattern. There is also a problem that a periodical noise will occur in correspondence to a repeating period unless a fairly long repeating period is adopted.

It is, therefore, an object of the invention to overcome the problems of the periodical noise and the monotonousness of the tone color change due to the repeated reading in the system storing not waveshape data of a full waveshape but that of a partial waveshape of plural periods in a waveshape memory and thereby being capable of generating a tone signal of a relatively high quality using this stored waveshape and saving capacity of the waveshape memory.

SUMMARY OF THE INVENTION

The tone signal generation device according to the invention is characterized in that it comprises a waveshape memory for storing waveshape data corresponding to plural waveshapes each of which has plural periods, reading sequence control means for designating ones to be read out among said waveshape data and readout order thereof, and reading means for reading said designated waveshape data in said designated readout order.

The waveshape data to be read out from the waveshape memory is sequentially switched in accordance with the readout order designated by the sequence control means and the waveshapes of plural periods of the respective waveshape data are combined in the order of combination according to the order of switching to form a tone signal. By this arrangement repetitive reading of the same waveshape of plural periods can be basically avoided whereby occurrence of a periodical noise can be eliminated and the tone color change also is no longer a monotonous repetition but becomes a complicated one. Since plural waveshape sections each consisting of plural periods are combined, a tone signal obtained is a high quality signal whose waveshape changes in a complicated manner. Besides, the capacity of the waveshape memory can be reduced in comparison with a case where a full waveshape is stored in the waveshape memory.

In a preferred embodiment of the invention, the plural waveshapes to be stored in the waveshape memory are ones scatteringly extracted from a musical tone waveshape from a start to an end of sounding. The reading sequence control means designates waveshape data different from the previously read waveshape data.

By way of example, random number generation means for generating a random number is provided, and the reading sequence control means designates randomly readout order of the waveshape data in accordance with the random number generated by the random number generation means. By way of another example, the reading sequence control means comprises a sequence memory prestoring the readout order of the waveshape data and controls the order of readout in accordance with the readout order in the sequence memory.

Embodiments of the invention will now be described with reference to the accompanying drawings.

BRIEF DESCRIPTION OF THE DRAWINGS

In the accompanying drawings.

DESCRIPTION OF PREFERRED EMBODIMENTS

Figure 1:
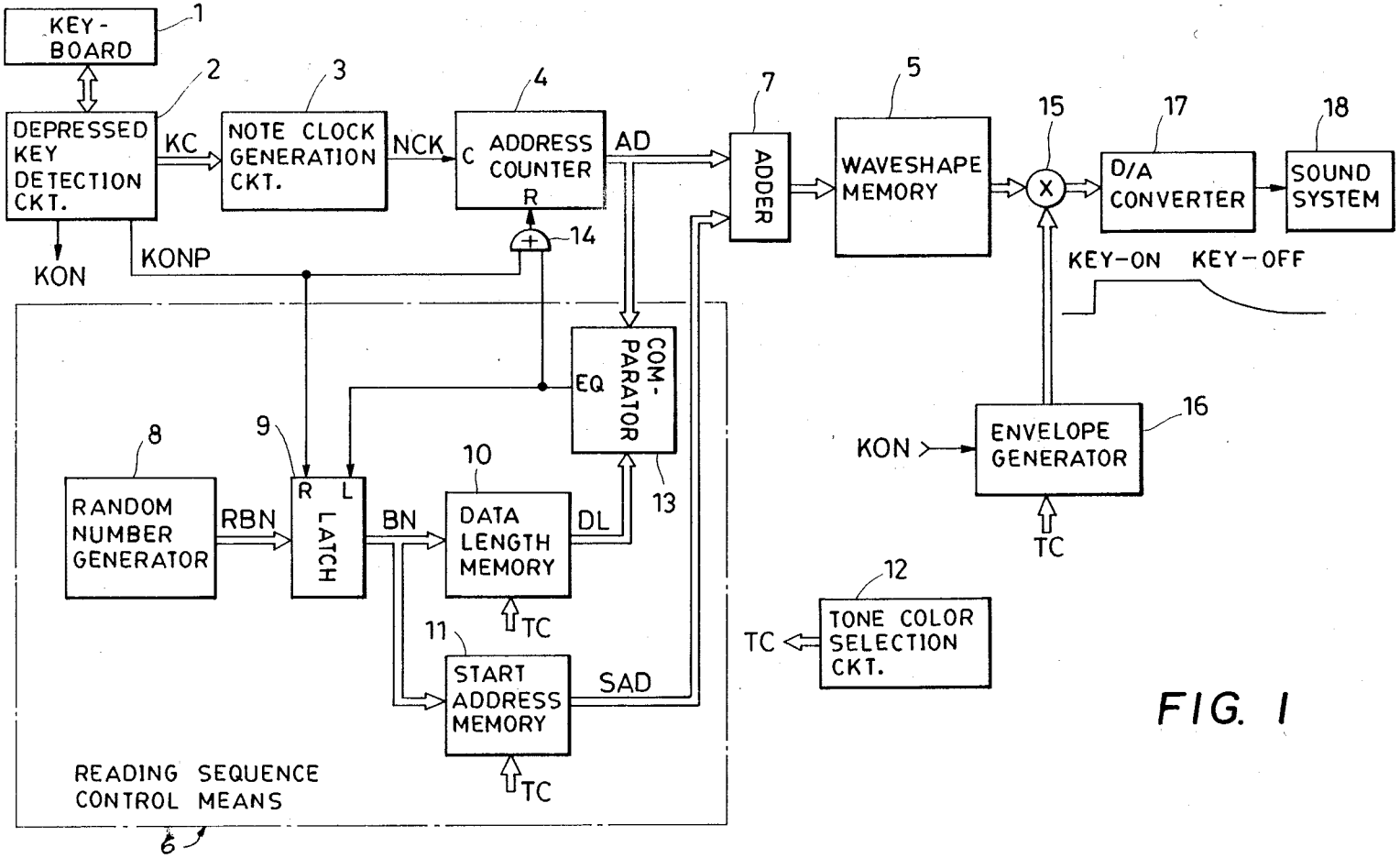
FIG. 1 is a block diagram of an electronic musical instrument showing an embodiment of the tone signal generation device according to the invention.

FIG. 1 shows an embodiment of the invention applied to a keyboard type electronic musical instrument. A keyboard 1 has playing keys which designate tone pitches of tones to be generated. A depressed key detection circuit 2 detects a depressed key in the keyboard 1 and thereupon produces a key code KC corresponding to the depressed key and also produces a key-on signal KON which maintains a signal "1" during depression of the key and a key-on pulse KONP which turns instantaneously to a signal "1" at the start of depression of the key. For brevity of explanation, the electronic musical instrument of this embodiment is assumed to be a monophonic type electronic musical instrument and the depressed key detection circuit 2 is assumed to have a monophonic selection function. It should be understood, however, that the invention can be applied to a polyphonic electronic musical instrument by employing a known key assigner.

A note clock generation circuit 3 generates, responsive to the key code KC supplied by the depressed key detection circuit 2, a note clock signal NCK of a frequency corresponding to the tone pitch of the depressed key. An address counter 4 receives the note clock signal NCK at its count input C and counts it to form an address signal AD used for accessing a waveshape memory 5. More specifically, the address signal AD formed by this address counter 4 is an address signal for reading out a waveshape of plural periods included in one waveshape section.

Figure 2:
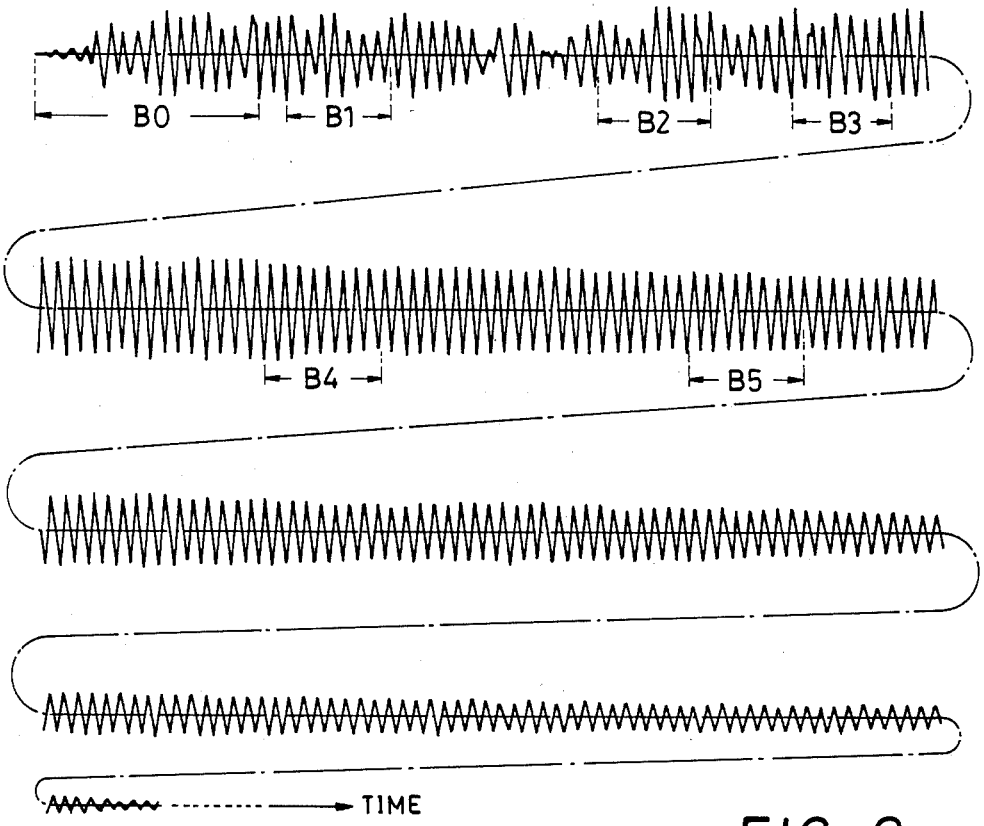
FIG. 2 is a diagram showing an example of an original tone waveshape and an example of waveshape sections scatteringly extracted from this original tone waveshape.
Figure 3:
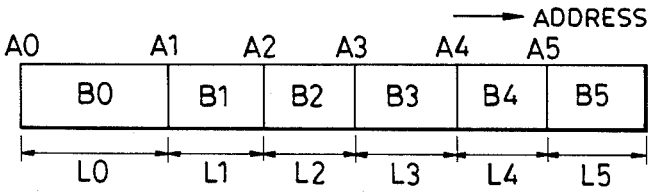
FIG. 3 is a diagram showing schematically a memory map of respective waveshape sections in the waveshape memory of FIG. 1.

The waveshape memory 5 stores respective waveshape data of waveshape sections each consisting of a waveshape of plural periods. The waveshape memory 5 stores waveshape data of a specific number of waveshape sections with respect of each tone color kind. An example of waveshape sections with respect to one tone color to be stored in the waveshape memory 5 is shown in FIG. 2. As shown in the figure, plural waveshape sections B0–B5 each consisting of plural periods are extracted scatteringly from a full waveshape from the start of sounding of a tone signal corresponding to a specific tone color to the end thereof. In extracting waveshape sections, the waveshape section B0 consisting of plural periods corresponding to the attack portion should preferably be included in waveshape sections to be extracted. The waveshapes of the extracted waveshape sections B0–B5 are coded in a suitable coding system such as the PCM (pulse code modulation) system and coded waveshapes data are stored in predetermined memory regions in the waveshape memory 5. This memory format is schematically shown in FIG. 3. The waveshape data of the respective waveshape sections B0–B5 are sequentially stored in continuous addresses. Since the number of periods of the waveshape extracted as one waveshape section is arbitrarily determined, length of data, i.e., the number of sample points, of waveshape data of each of the respective waveshape sections B0–B5 has its own value. In FIG. 3, symbols L0–L5 represent lengths of data of the respective waveshape sections B0–B5 and symbols A0–A5 represent start addresses, i.e., addresses storing waveshape data of the first sample points of the waveshape sections B0–B5. The memory regions of the respective waveshape sections B0–B5 in the waveshape memory 5 can be determined by these start addresses A0–A5 and the data lengths L0–L5. In the following description, the memory region in the waveshape memory 5 storing waveshape data of each of the waveshape sections B0–B5 is hereinafter referred to as "bank". For example, a bank which stores waveshape data of the waveshape section B0 is a memory region of data length L0 starting with the start address A0. In FIG. 3, a memory format for one tone color only is shown but the same is the case with other memory formats of other tone colors. Since data length of each waveshape section can be arbitrarily determined in respect of each tone color and the memory region therefor is different, value of the start address differs tone color by tone color.

Reading sequence control means 6 is provided for designating a waveshape to be read out from the waveshape memory 5 while sequentially switching the waveshape section and produces a start address designation signal SAD for designating a waveshape section to be read out. This start address designation signal SAD indicates one of the start addresses A0–A5 for the waveshape sections B0–B5 to be read out. The start address designation signal SAD and the address signal AD from the address counter 4 are added together in an adder 7 and an addition output is applied to an address input of the waveshape memory 5. An absolute address of each sample point in one waveshape section to be read out is specified by this addition output (SAD+AD) and waveshape data of the sample point stored at the specified address is read out from the waveshape memory 5.

Reading sequence control means 6 comprises a random number generator 8 which generates a random number within a range of, for example, 1–5. A random number signal RBN generated by the random number generator 8 corresponds randomly to the numbers of the respective waveshape sections B1–B5 excluding the waveshape section B0 of the attack portion. This random number signal RBN is applied to a latch circuit 9. The latch circuit 9 receives at its reset input R the key-on pulse KONP and is reset at the beginning of depression of the key. The output of the latch circuit 9 is supplied to address inputs of a data length memory 10 and a start address memory 11 as a bank number BN designating the number of a waveshape section (one of the waveshape sections B0–B5) to be designated. The data length memory 10 prestores data lengths L0–L5 of the respective waveshape sections B0–B5 with respect to each tone color kind. A set of data lengths L0–L5 is selected in response to the tone color selection information TC supplied from a tone color selection circuit 12 and data length (one of L0–L5) of one waveshape section corresponding to the applied bank number BN is selectively read out from among the selected data lengths L0–L5. The read out data length signal DL is applied to one.input of a comparator 13 and compared with the address signal AD which is applied to another input of the comparator 13. When the numerical values of the two inputs coincide with each other (i.e., when AD=DL), a signal "1" is produced from a coincidence output EQ and applied to a latch control input L of the latch circuit 9 and also to a reset input R of the address counter 4 through an OR gate 14. To the reset input R of the address counter 4 is also applied the key-on pulse KONP through the OR gate 14.

The start address memory 11 prestores start addresses A0–A5 of the respective waveshape sections B0–B5 with respect to each tone color kind. A set of start addresses A0–A5 is selected in response to the tone color selection information TC and a start address (one of A0–A5) of one waveshape corresponding to applied bank number BN is selectively read out from among the selected start addresses A0–A5. The read out start address is applied to the adder 7 as a start address designation signal SAD.

Since the latch circuit 9 is reset when the key-on pulse KONP has been generated, the bank number BN initially is "0" and designates the waveshape section B0 consisting of plural periods in the attack portion. The data length memory 10 provides "L0" as the data legnth signal DL whereas the start address memory 11 provides "A0" as the start address designation signal SAD. In the meanwhile, the address counter 4 starts counting of the note clock signal NCK after being reset by the key-on pulse KONP thereby gradually increasing the address signal AD from "0". When the address signal AD has become equal to "L0" of the data length signal DL, the coincidence output EQ of the comparator becomes "1" whereby switching of the bank (i.e., switching of the waveshape section to be read out) is ordered.

The latch circuit 9 latches the random number signal RBN at a timing at which the signal "1" is applied to the latch control input L and outputs it as a new bank number BN. The second and subsequent bank numbers BN therefore randomly designate the waveshape sections B1–B5. Since the address counter 4 is once reset by the coincidence signal EQ of the comparator 13, the address signal AD is returned to "0" each time the waveshape section is switched and its increase is repeated. Accordingly, when the address signal AD has changed by a number equal to the data length (one of L1–L5) of the designated waveshape section (one of B1–B5), the coincidence condition of the comparator 13 is satisfied and the waveshape section to be read out thereby is switched. The order of switching between the waveshape sections B1–B5 is entirely random.

While one waveshape section is designated, the start address designation signal SAD does not change but the address signal AD gradually changes in response to the note clock signal NCK. The output of the adder 7 (SAD+AD) thereby increases one address by one address starting from the start address (one of A0–A5) of the designated waveshape section and, in response to this address signal, waveshape data of continuous sample points of this waveshape section is sequentially read out from the waveshape memory 5.

The waveshape data of the respective sample points read out from the waveshape memory 5 is applied to a multiplier 15 where it is multiplied with an envelope signal supplied by an envelope generator 16. The output of the multiplier 15 is supplied to a digital-to-analog converter 17 for being converted to an analog signal and thereafter is supplied to a sound system 18.

The envelope generator 16 generates, responsive to the key-on signal KON, an envelope signal which, for example, maintains a constant level during depression of the key and attenuates with predetermined decay characteristics after release of the key. The tone color selection information TC is applied to the envelope generator 16 and characteristics of the envelope signal such as the decay characteristics are determined in accordance with the selected tone color. The envelope signal need not have attack characteristics because the waveshape data of the respective waveshape sections stored in the waveshape memory 5 have amplitude envelope characteristics of the original tone waveshape as shown in FIG. 2 and, accordingly, the waveshape data of the waveshape section B0 of the attack portion is previously imparted with the envelope of attack characteristics so that no particular arrangement for further imparting the envelope of the attack characteristics is necessary in a posterior stage. The invention, however, is not limited to this but, alternatively, the amplitude of the original tone waveshape as shown in FIG. 2 may be standardized so that it is unified to a certain level and this waveshape data which has been standardized in its amplitude level may be stored in the waveshape memory 5. In this case, an envelope signal having all characteristics of attack, decay, sustain and release should be generated by the envelope generator 16.

In the embodiment of FIG. 1, the second and subsequent waveshape sections are designated entirely randomly so that there is possibility that the waveshape section B4 or B5 which is in the middle of or near to the end of the sustain portion is designated immediately after the waveshape section B0 of the attack portion has been read out. This may result in generation of a tone of an unnatural tone color. For overcoming this problem, the reading sequence control means 6 may be modified as shown in FIG. 4 so as to timewise limit the range of the random number.

Figure 4:
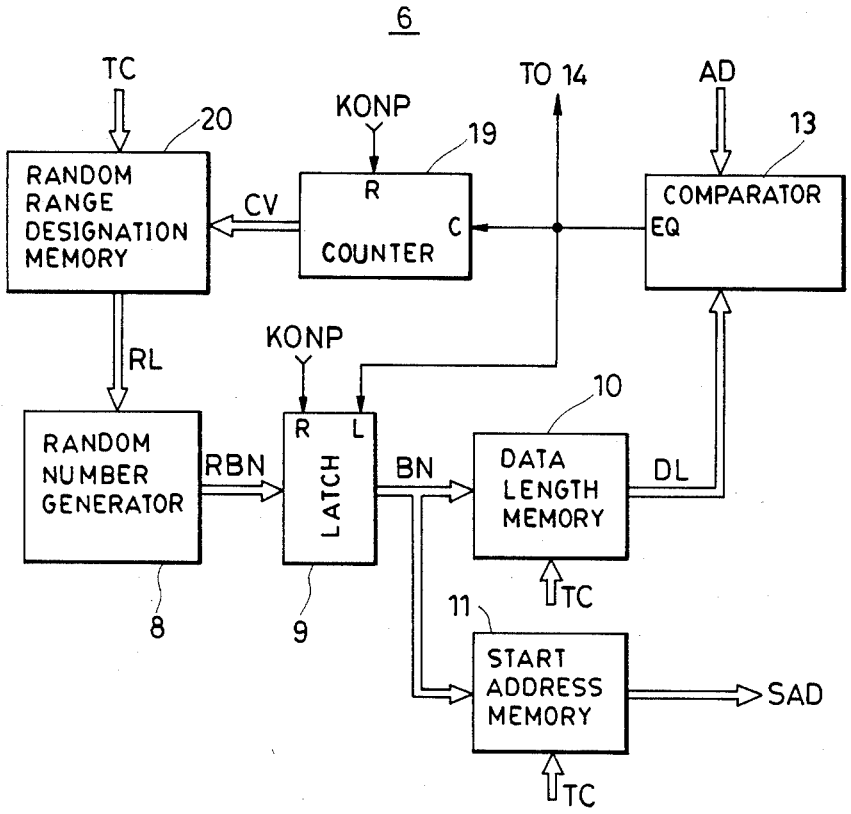
FIG. 4 is a block diagram showing a modified example of reading sequence control means of FIG. 1.

The embodiment shown in FIG. 4 additionally comprises a counter 19 which counts the number of switching of the waveshape section by counting the coincidence output signal of the comparator 13 and a random range designation memory 20 which provides, responsive to a count value CV of this counter 19, random range designation data RL. The counter 19 is reset by the key-on pulse KONP. The random range designation memory 20 prestores data RL which designates the range of the random number in accordance with various count values CV. The memory 20 stores a group of such data with respect to each tone color kind and selects a group of data to be read out in response to the tone color selection information TC. An example of the random range designation data RL corresponding to the respective count values CV is shown in the following Table 1. In this table, the colum of RL describes not the random numbers themselves but the symbols B1–B5 of the waveshape sections corresponding to these random numbers.

TABLE 1

| CV | RL |
|---|---|
| 0–2 | B1–B2 |
| 2–5 | B2–B3 |
| 5–8 | B3–B4 |
| 8– | B4–B5 |

The random number generator 8 randomly generates numerical values within a range designated by the random range designation data RL supplied from the memory 20. According to Table 1, the numbers 1 and 2 are randomly generated in the range in which the number of switching of the waveshape section is 0–2, i.e., in the vicinity of the attack portion and the waveshape sections B1 and B2 which are relatively close to the attack portion thereby are randomly designated. When the number of switching of the waveshape section is 8 and thereafter, i.e., when some period of time has elapsed from depression of the key, the numbers 4 and 5 are randomly generated and the waveshape sections B4 and B5 which are in the middle or near to the end of the sustain portion thereby are randomly designated.

In the embodiment of FIG. 4, the random range is timewise limited using the number CV of switching of the waveshape section as a parameter. The invention is not limited to this but the random range may be timewise limited using an output of a timer circuit or attack, decay, sustain and release states in the envelope signal as the parameter.

Figure 5:
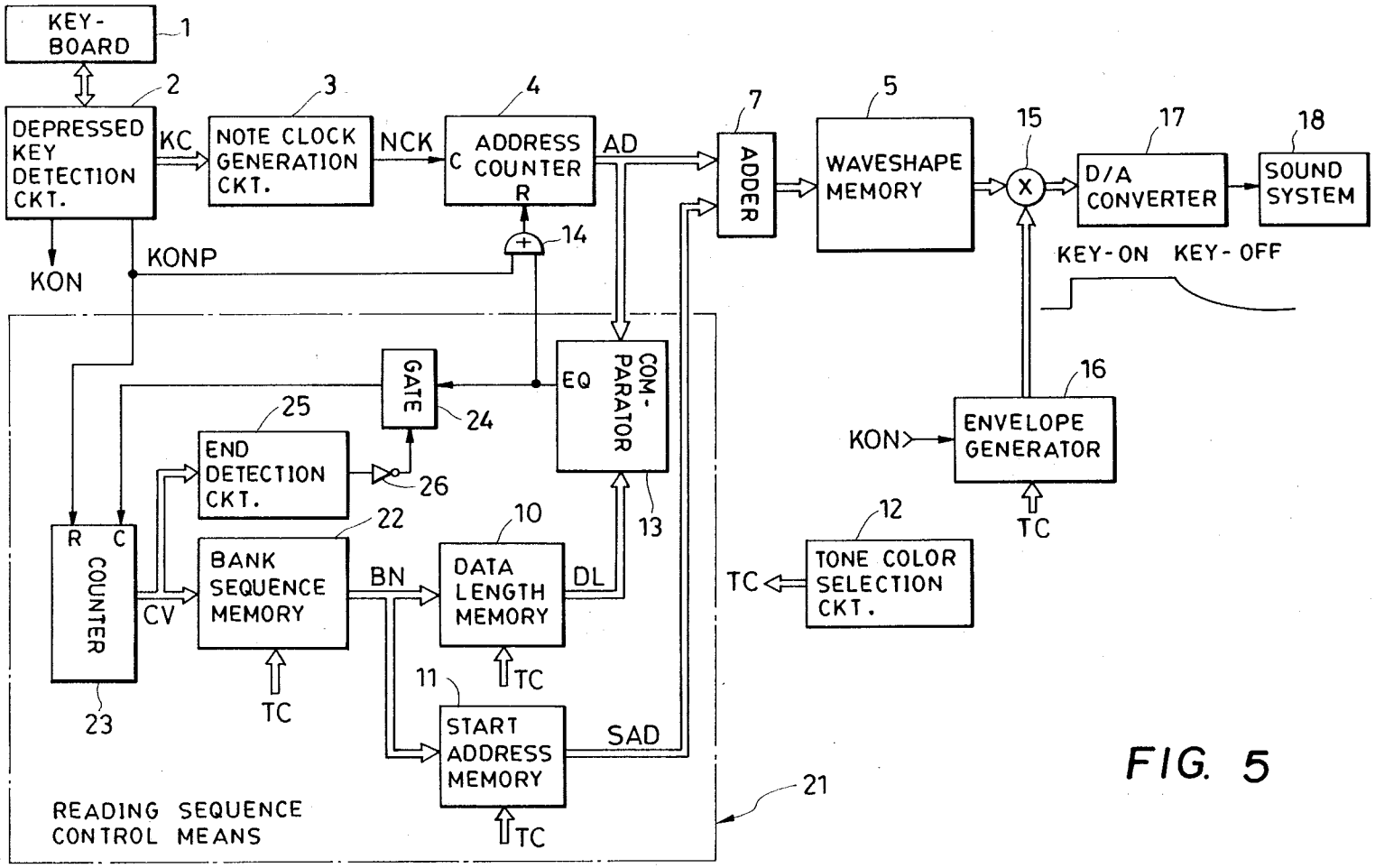
FIG. 5 is a block diagram showing another embodiment of the invention.

FIG. 5 shows another embodiment of the invention. In this embodiment, the reading sequence control means 21 is modified from the one shown in FIG. 1. Blocks designated by the same reference characters as in FIG. 1 represent the same component parts as in FIG. 1. This reading sequence control means 21 comprises a bank sequence memory 22 prestoring the order of switching of the waveshape sections B0–B5 and controls the switching of the waveshape section in accordance with the order of switching stored in this memory 22. A counter 23 counts the number of switching of the waveshape section in the same manner as the counter 19 of FIG. 4. The counter 23 is reset by the key-on pulse KONP and receives at its count input C the coincidence output signal EQ of the comparator 13 through a gate 24. The count value CV of the counter 23 is applied to the address input of the memory 22 causing the memory 22 to provide the bank number BN indicating a waveshape section of the order corresponding to this count value. This bank number BN is supplied to the addresses of data length memory 10 and start address memory 11 in the same manner as in the embodiment of FIG. 1.

An example of contents stored in the bank sequence memory 22 is shown in the following Table 2. The memory 22 stores the bank number BN (B0–B5) to be read out in response to the respective count values CV (i.e., the numbers of switching). The storage of such order of switching is made in respect of each tone color kind and the sequence to be read out is selected in accordance with the tone color selection information TC.

TABLE 2

| CV | 0 | 1 | 2 | 3 | 4 | 5 | 6 | 7 | 8 | ... |
|---|---|---|---|---|---|---|---|---|---|---|
| BN | B0 | B1 | B2 | B3 | B2 | B4 | B5 | B3 | B4 | ... |

The order of switching of the waveshape section to be stored in the memory 22 is determined randomly so that there will occur as little periodicity in the order as possible. Even in this case, the waveshape section B0 should preferably come first. Since one sequence which is storable in the memory 22 is of a limited length, some suitable arrangement must be made when the count value has reached a waveshape section of a last order. To this end, an end detection circuit 25 is provided. This circuit 25 detects that the count value CV has reached a predetermined final value and thereupon outputs a signal "1". The output of the end detection circurt 25 is inverted by an inverter 26 and applied to a control input of the gate 24. The gate 24 is always opened and enables counting of the number of switching of the waveshape section by supplying the coincidence output signal to the counter 23. When the count value CV has reached the final value, the gate 24 is closed and thereby prohibits further counting of the number of switching. Accordingly, upon reaching of the waveshape section of the last order, that waveshape section is repeated thereafter. However, such repetition of the same waveshape section can be prevented by employing a sufficient length for one sequence length (i.e., sufficient order numbers).

Figure 6:
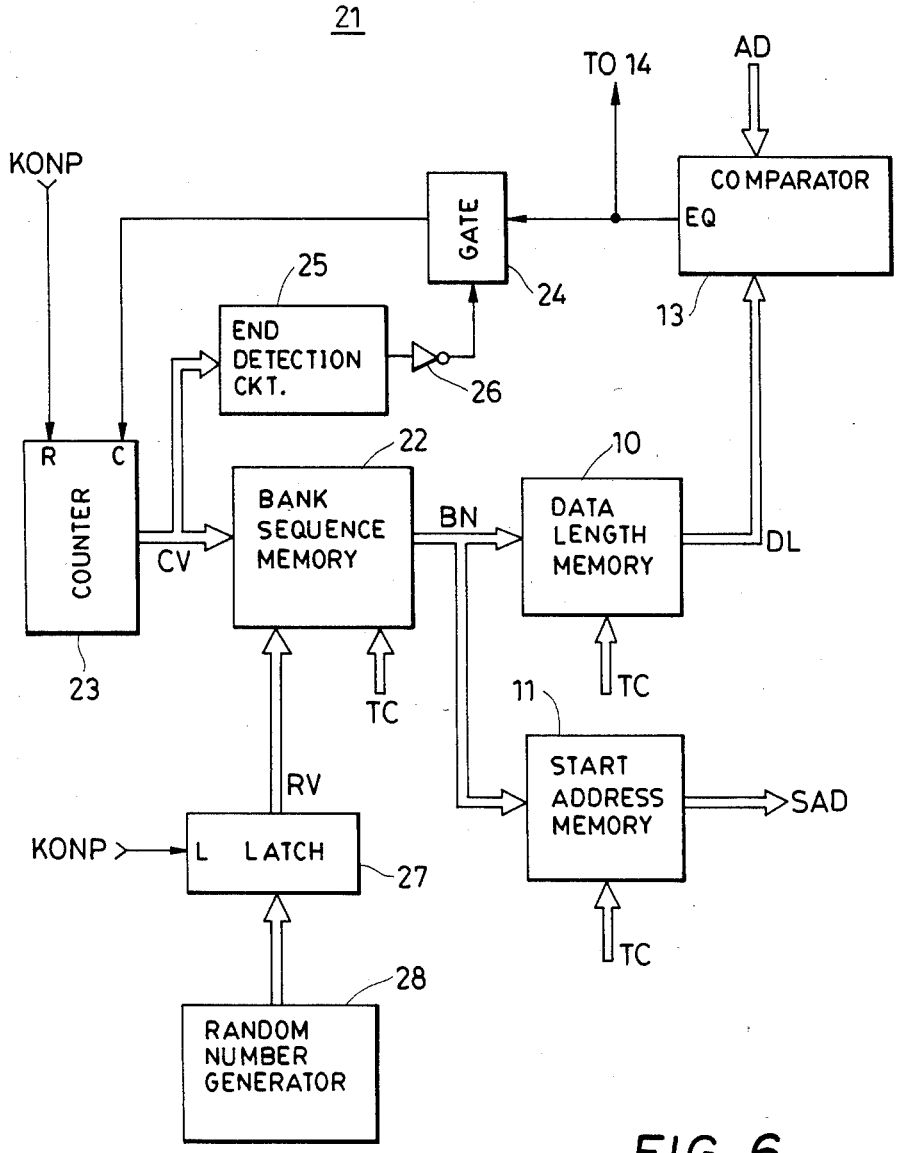
FIG. 6 is a block diagram showing a modified example of the reading sequence control means of FIG. 5.

FIG. 6 is a modified example of the reading sequence control means 21 of FIG. 5. This modified example additionally comprises a random number generator 28 so as to make a random selection of sequence (i.e., order of switching) to be read out from the bank sequence memory 22. In this case, the bank sequence memory 22 stores not a single sequence but plural sequences with respect to one tone color kind. An example of contents stored in a case where three sequences are stored is shown in the following Table 3.

TABLE 3

| | 0 | 1 | 2 | 3 | 4 | 5 | 6 | 7 | 8 | ... |
|---|---|---|---|---|---|---|---|---|---|---|
| BN when RV = 3 | B0 | B1 | B2 | B3 | B2 | B4 | B5 | B3 | B4 | ... |
| BN when RV = 2 | B0 | B2 | B1 | B4 | B3 | B5 | B3 | B4 | B5 | ... |
| BN when RV = 3 | B0 | B1 | B3 | B2 | B4 | B5 | B3 | B5 | B4 | ... |

A random number generator 28 randomly generates, for example, numbers 1–3. A latch circuit 27 latches the random number generated by the random number generator 28 at a timing of the key-on pulse KONP and supplies its output data RV to the memory 22. The memory 22 selects one sequence corresponding to the data RV supplied from the latch circuit 27 from among plural sequence selected in accordance with the tone color selection information TC and sequentially provides the bank number BN included in this sequence in response to the count value CV (number of switching). In this manner, the reading sequence is randomly selected for each key.

Instead of selecting the sequence to be read out from the bank sequence memory 22 in accordance with the tone color selection information TC or the random signal RV as in the embodiment of FIG. 5 or FIG. 6, the sequence may be selected in accordance with key touch data or tone pitch data.

In the embodiments of FIGS. 1 through 6, the data length memory 10 is provided, for data lengths L0–L5 are respectively determined as desired. If the waveshape sections are selected in such a manner that the data lengths L0–L5 become equal to one another, the dta length memory 10 is obviated and the data length signal DL is set at a fixed vauue.

For smoothing connection between the respective waveshape sections, interpolation may be applied in accordance with a predetermined interpolation function in a section between an end portion of a certain width in a preceding waveshape section and a beginning portion of a certain width of a following waveshape section. An interpolation circuit for effecting such interpolation can be constructed by employing a known interpolation technique so that detailed description thereof will be omitted.

The coding system for coding waveshape data to be stored in the waveshape memory 5 is not limited to the above described PCM system but one of other suitable coding systems such as the difference PCM system, the delta modulation (DM) system, the adapted PCM system and the adapted delta modulation (ADM) system may be employed. In this case, a demodulation circuit for demodulating (i.e., obtaining a pulse code modulated signal) a read out output of the waveshape memory 5 according to the employed coding system should be provided on the output side of the waveshape memory 5.

In the above described embodiments, the invention has been applied to a device for generating tones of scale notes selected in the keyboard 1. The invention, however, is not limited to this but is applicable to a device for generating rhythm sounds (percussion instrument sounds).

In the above described embodiments, the address signal AD for reading waveshape data of respective sample points from the waveshape memory 5 is generated by counting the note clock signal NCK. Alternatively, the address signal AD may be generated by accumulating or adding or subtracting frequency data corresponding to the tone pitch of the depressed key. If the waveshape memory is suitably modified, the address signal AD need not be a digital code of plural bits but the note clock signal NCK may be directly used as the address signal AD. Further, in a case where separate waveshape data is stored for each tone pitch in the waveshape memory, the address signal AD may be generated at a changing rate which is common to all tone pitches.

In the above described embodiments, the waveshape memory 5 is constructed of a physically single memory device and partial memory regions thereof are allotted to the storage of the respective waveshape sections. Alternatively, separate waveshape memories may be used for individually storing the respective waveshape sections.

What is claimed is:

1. A tone signal generation device comprising:

waveshape memory means for storing waveshape sample data corresponding to plural waveshapes each of which contains plural periods and a fixed number of samples, wherein the waveshapes are different from each other and form portions of a single tone to be produced;

reading sequence control means for indicating waveshapes to be read out from the memory means and the readout order thereof; and reading means for reading said designated waveshape date in said designated readout order to form a tone comprised of the combination of the plural waveshapes.

2. A tone signal generation device as defined in claim 1 wherein said plural waveshapes correspond to various portions of a musical tone waveshape from a start to an end of sounding.

3. A tone signal generation device as defined in claim 1 wherein said reading sequence control means designates waveshape data different from the previously read waveshape data.

4. A tone signal generation device as defined in claim 1 further comprising random number generation means for generating a random number and wherein said reading sequence control means designates randomly a readout order of said waveshape data in accordance with said random number.

5. A tone signal generation device as defined in claim 1 wherein said reading sequence control means comprises a sequence memory prestoring the readout order of said waveshape data and controls the order of readout in accordance with said readout order.

6. A tone signal generation device as defined in claim 1 wherein said reading sequence control means comprises a random number generator capable of varying the range of a random number to be generated, means for variably controlling the range of the random number generated in said random number generator with lapse of time from the start of sounding of the tone and means for designating waveshape data to be read out from said waveshape memory in response to the random number generated by said random number generator.

7. A tone signal generation device as defined in claim 1 wherein said reading sequence control means comprises a sequence memory prestoring sets of readout order of the waveshape data to be read, selection means for selecting one of said sets and means for controlling readout of said waveshape data in accordance with the readout order of the selected set.

8. A tone signal generation device as defined in claim 7 wherein said selection means randomly selects one of said sets at the start of sounding of the tone.

9. An electronic musical instrument comprising:

keys for designating tone pitches of tones to be generated;

depressed key detection means for detecting a depressed key or keys;

waveshape memory means for storing respective waveshape sample data representing plural waveshapes, each of which contains plural periods and has a fixed number of samples, wherein the waveshapes are different from each other and form portions of a single tone to be produced;

reading sequence control means for designating a waveshape to be read out from the waveshape memory means, and for sequentially switiching the waveshape to be read out; and reading means for sequentially reading from said waveshape memory means the waveshapes designated by said reading sequence control means in accordance with the tone pitch of the depressed key to form a tone ot the desired pitch comprised of the combination of the designated waveshapes.

10. A tone signal generation device comprising waveshape memory means for storing waveshape sample data representing plural waveshapes, each of which contains plural periods and has a fixed number of samples and which waveshapes have different forms, wherein the tone waveshape of a tone to be produced is constructed on the basis of said plural waveshapes;

reading sequence control means for designating a waveshape to be read out from among said plural waveshapes in accordance with one of a predetermined order or at random; and reading means for reading out waveshape sample data corresponding to the designated waveshape once;

said reading sequence control means further designating a next waveshape to be read out next from among said plural waveshapes in response to the readout of an immediately preceding designated waveshape and in accordance with said predetermined order or at random, said reading means further reading out waveshape data corresponding to the next and each subsequently designated waveshape data once so that said tone is constructed on the basis of the combination of said plural waveshapes.

11. An electornic musical instrument comprising:

pitch designating means for designating a pitch of a tone to be produced;

waveshape memory means storing waveshape sample data representing plural waveshapes, each of which contains plural periods and has a fixed number of samples and which waveshapes have different forms, wherein the tone waveshape of said tone to be produced is constructed on the basis of said plural waveshapes;

reading sequence control means for designating a waveshape to be read out among said plural waveshapes in accordance with one of a predetermined order or at random; and reading means for reading from said waveshape memory means waveshape sample data corresponding to the designated waveshape once at a rate corresponding to said pitch;

said reading sequence means further designating a next waveshape to be read out next from among said plural waveshapes in response tothe readout of the immediately preceding designated waveshape and in accordance with said predetermined order or at random, said reading means further reading out at said rate waveshape data corresponding to the next and each subsequently designated waveshape data once so that said tone waveshape is constructed on the basis of the combination of said plural waveshapes.

12. A tone signal generation device for forming a tone signal corresponding to a single note comprising:

waveshape memory meas for storing waveshape sample data corresponding to plural different waveshapes, each of which contains plural periods and has a fixed number of samples and wherein said waveshapes form portions of a tone signal to be produced;

reading sequence control means for indicating a sequence in which the waveshapes are to be read out, the sequence including at least some of the waveshpaes more than once alternating with other of the waveshapes; and reading means for reading the waveshape sample data from the memory means in accordance with the sequence to form a tone signal corresponding to a single note.

* * * * *